US011918066B2

(12) United States Patent
Fink

(10) Patent No.: US 11,918,066 B2
(45) Date of Patent: Mar. 5, 2024

(54) ADJUSTABLE STRAP

(71) Applicant: Matthew Fink, Weston, MA (US)

(72) Inventor: Matthew Fink, Weston, MA (US)

( * ) Notice: Subject to any disclaimer, the term of this patent is extended or adjusted under 35 U.S.C. 154(b) by 227 days.

(21) Appl. No.: 17/322,594

(22) Filed: May 17, 2021

(65) Prior Publication Data

US 2022/0361610 A1 Nov. 17, 2022

(51) Int. Cl.
*A41F 1/06* (2006.01)
*A41F 1/00* (2006.01)
*A41F 15/00* (2006.01)

(52) U.S. Cl.
CPC ..... *A41F 15/002* (2013.01); *A41F 1/006* (2013.01); *A41F 1/06* (2013.01)

(58) Field of Classification Search
CPC ..... A41F 15/002; A41F 1/006; A41F 1/06
USPC ..... 450/86
See application file for complete search history.

(56) References Cited

U.S. PATENT DOCUMENTS 2,970,597 A * 2/1961 Michel ..... A41C 3/02 450/71
4,325,378 A * 4/1982 Wilkinson ..... A41C 3/0057 450/77
5,040,524 A 8/1991 Votel et al.
5,152,741 A * 10/1992 Farnio ..... A61F 13/145 602/61
5,429,593 A * 7/1995 Matory ..... A61F 13/145 602/61
5,538,502 A * 7/1996 Johnstone ..... A41C 3/02 602/61
5,951,364 A * 9/1999 Brown ..... A41C 3/02 450/86
6,123,601 A * 9/2000 Hildebrandt ..... A41F 1/006 450/82
6,165,045 A * 12/2000 Miller ..... A41C 3/0057 450/17
6,319,091 B1 * 11/2001 Kilbride ..... A41C 3/02 450/17
7,931,521 B1 * 4/2011 Griffin ..... A41F 15/002 450/86
8,439,722 B2 * 5/2013 Buriak ..... A41C 3/02 450/71
8,460,054 B2 6/2013 Swendseid
(Continued)

FOREIGN PATENT DOCUMENTS

FR 2891440 A1 4/2007

OTHER PUBLICATIONS

Written Opinion of the International Searching Authority in PCT/US2022/029447 (dated Aug. 30, 2022).
(Continued)

*Primary Examiner* — Gloria M Hale
(74) *Attorney, Agent, or Firm* — Pryor Cashman LLP

(57) ABSTRACT

A strap and garments including said strap, said strap including a first layer including an elastic material, a second layer including a fabric material and having a first portion and a second portion, the second layer attached to the first layer, and a reversibly attachable fastening element attached to the first portion of the second layer, where the fastening element is configured to attach to the second portion of the second layer when the strap is folded onto itself and the fastening element is brought into contact with the second portion of the second layer.

20 Claims, 3 Drawing Sheets

(56) References Cited

U.S. PATENT DOCUMENTS

| | | | | |
|---|---|---|---|---|
| 8,708,773 | B2 * | 4/2014 | Afxentiou | A41C 3/0021 450/86 |
| 9,700,083 | B2 * | 7/2017 | DeCotiis | A41C 3/0028 |
| 9,918,500 | B2 * | 3/2018 | Tempesta | A41C 3/0028 |
| 9,993,036 | B2 | 6/2018 | Swendseid et al. | |
| 2001/0019933 | A1 | 9/2001 | Wagner | |
| 2012/0302137 | A1 * | 11/2012 | Moylan | A41C 3/0057 450/86 |
| 2016/0081399 | A1 * | 3/2016 | Tempesta | A41C 3/0014 450/70 |
| 2016/0249688 | A1 | 9/2016 | Ibey et al. | |
| 2016/0367881 | A1 | 12/2016 | Le et al. | |
| 2017/0265528 | A1 * | 9/2017 | Tempesta | A41C 3/0057 |
| 2017/0265529 | A1 * | 9/2017 | Tempesta | A41C 3/0014 |
| 2018/0310641 | A1 * | 11/2018 | Melendez | B32B 7/12 |
| 2020/0397064 | A1 * | 12/2020 | Liu | A41B 9/14 |

OTHER PUBLICATIONS

International Search Report in PCT/US2022/029447 (dated Aug. 30, 2022).

* cited by examiner

ADJUSTABLE STRAP

TECHNICAL FIELD

The present invention relates generally to adjustable straps, and particularly to adjustable straps used in apparel, such as brassieres, sport gloves, and the like.

BACKGROUND OF THE INVENTION

Brassieres commonly include shoulder straps, which displace a portion of the weight supported by the brassiere from a wearer's back to the wearer's shoulders. Wearers often find these straps to be uncomfortable, as the straps exert pressure on their shoulders, can dig into the skin, and are difficult to adjust or remain in place, often being too loose or too tight when in use. There is a need for a strap and associated brassiere that adequately addresses these issues.

SUMMARY OF THE INVENTION

In general, in one aspect, the invention features a strap including a first layer including an elastic material, a second layer including a fabric material and having a first portion and a second portion, the second layer attached to the first layer, and a reversibly attachable fastening element attached to the first portion of the second layer, where the fastening element is configured to attach to the second portion of the second layer when the strap is folded onto itself and the fastening element is brought into contact with the second portion of the second layer.

Implementations of the invention may include one or more of the following features. The elastic material may be a non-slip material. The elastic material may include spandex. The fabric material may be microfiber or tricot. The fastening element may be a hook-and-loop fastener. The first portion of the second layer may be disposed at a first end of the strap. The first end of the strap may have a tapered shape.

In general, in another aspect, the invention features a garment including at least a strap, where the strap includes a first layer including an elastic material, a second layer including a fabric material and having a first portion and a second portion, the second layer attached to the first layer, and a reversibly attachable fastening element attached to the first portion of the second layer, where the fastening element is configured to attach to the second portion of the second layer when the strap is folded onto itself and the fastening element is brought into contact with the second portion of the second layer.

Implementations of the invention may include one or more of the following features. The garment may be a brassiere. The strap may be a shoulder strap. The garment may further include a ring through which the strap is passed and then is folded onto itself. The elastic material may be a non-slip material. The elastic material may include spandex. The fabric material may be microfiber or tricot. The fastening element may be a hook-and-loop fastener. The first portion of the second layer may be disposed at a first end of the strap. The first end of the strap may have a tapered shape. The garment may be a sport glove.

DETAILED DESCRIPTION OF THE INVENTION

Figure 1:
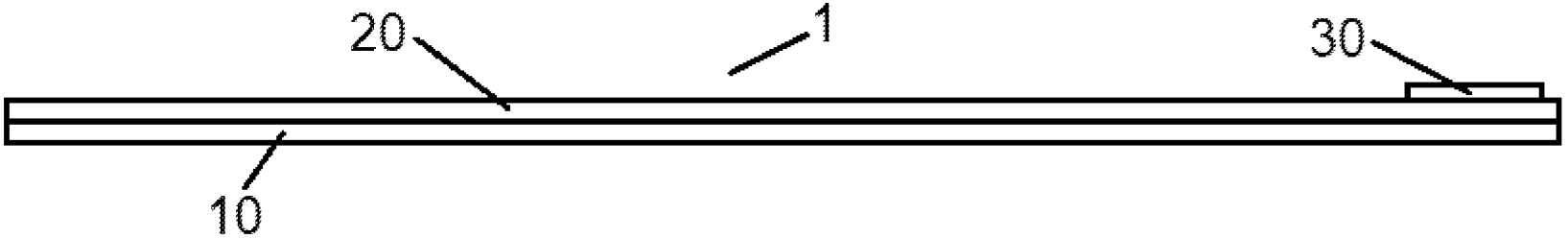
FIG. 1 is a front view of a strap according to one embodiment of the present invention.
Figure 2:
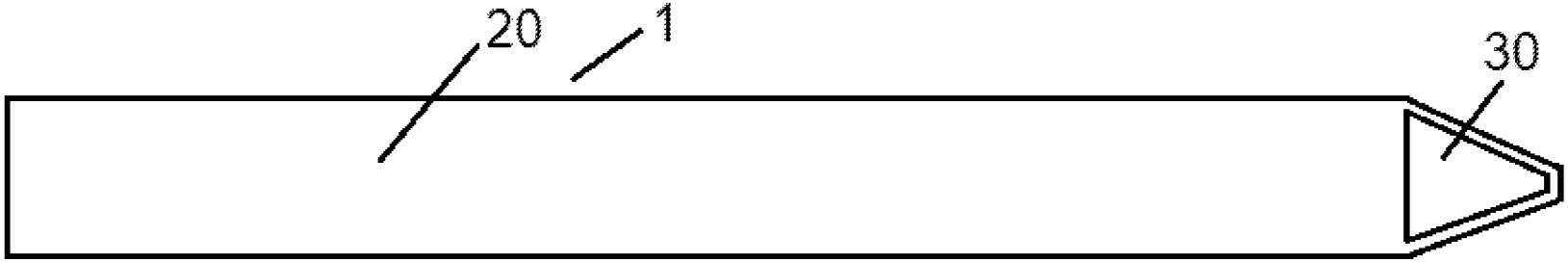
FIG. 2 is a top view of the strap of FIG. 1.
Figure 3:
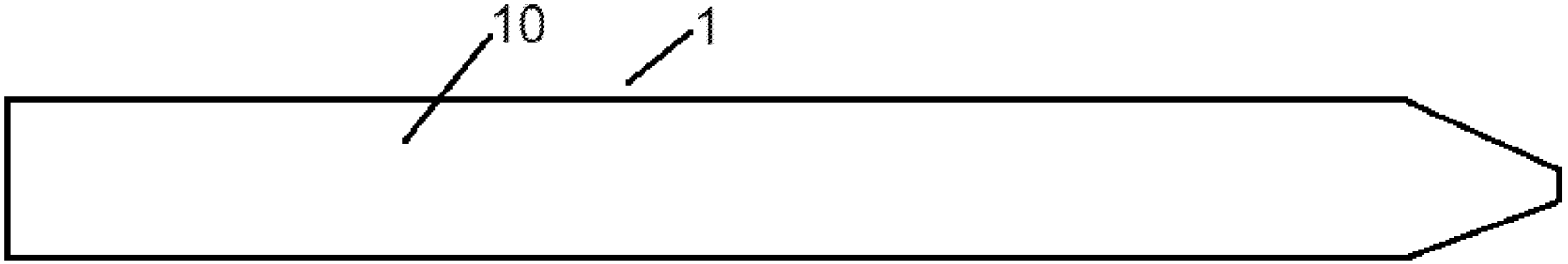
FIG. 3 is a bottom view of the strap of FIG. 1.
Figure 4:
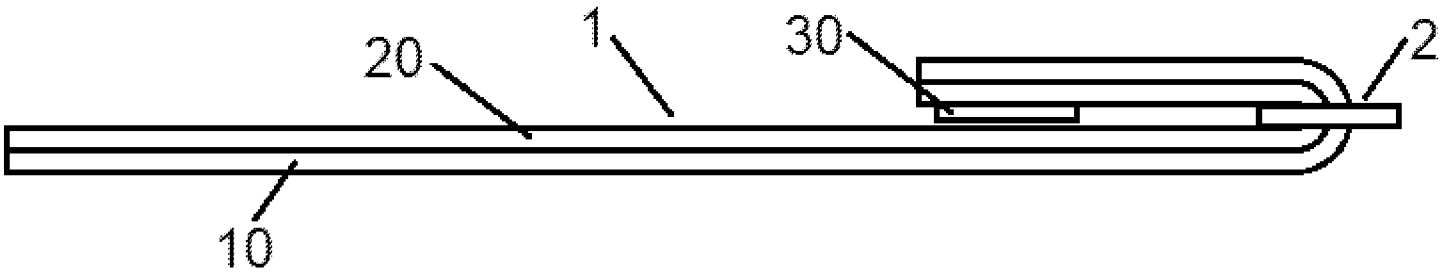
FIG. 4 is a front view of the strap of FIG. 1 looped around a ring.
Figure 5:
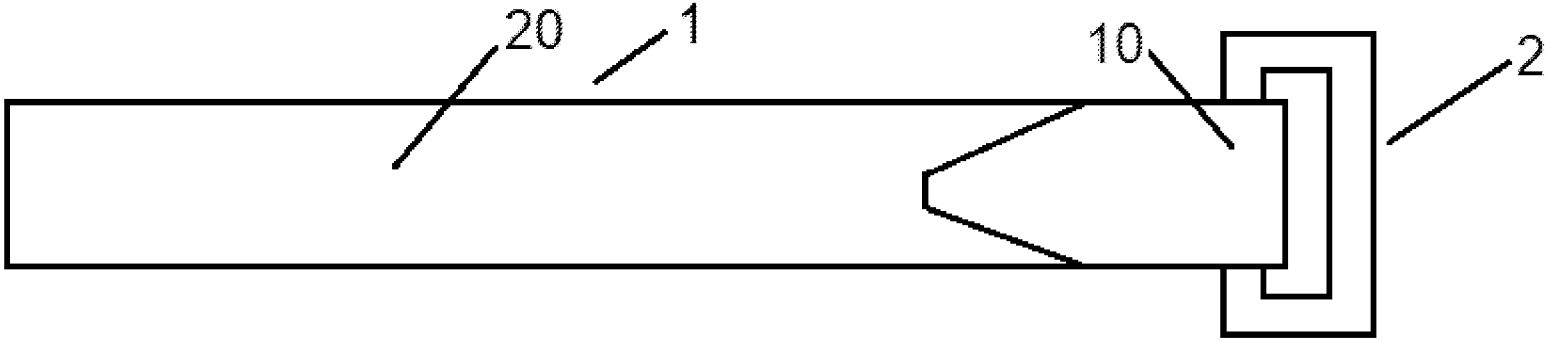
FIG. 5 is a top view of the strap of FIG. 1 looped around a ring.

FIGS. 1-5 illustrate a strap of an embodiment of the present invention, specifically strap 1 for use in apparel, such as brassieres, sport gloves, and the like. In the embodiment of FIGS. 1-5, strap 1 includes a first layer 10 and a second layer 20. First layer 10 and second layer 20 may be affixed or adhered to each other, such as by the use of hot melt, hot glue, or polyurethane, or may be disposed on and affixed or adhered to opposite sides of an intermediary layer or substrate, such as one composed of rubber.

In a preferred embodiment, first layer 10 is composed of a non-slip and/or elastic material, such as spandex. In a preferred embodiment, second layer 20 is composed of a fabric material, such as microfiber or tricot. In a preferred embodiment, first layer 10 of strap 1 is in contact with the user's skin or body, e.g., shoulder, wrist, hand, etc., and where first layer 10 is composed on a non-slip material, the strap is better able to maintain its position.

The strap of the present invention preferably has at least one fastening element on at least one end of the strap. The at least one end of the strap may have a tapered shape. In the embodiment of FIGS. 1-5, the tapered end of strap 1 includes fastening element 30 affixed or adhered to second layer 20, such as by the use of hot melt, hot glue, or polyurethane. The fastening element of the present invention may include any industry-accepted fastening mechanism, such as hook-and-loop fasteners or VELCRO. The fastening element of the present invention is preferably configured to reversibly attach to the strap, such as to the second layer, upon the strap being folded back onto itself, thereby creating a closed loop. Through this configuration, also illustrated in FIGS. 4-5, the strap may be employed in apparel by wrapping this closed loop around an element of the pertinent apparel, e.g., a ring in a brassiere, such as ring 2. The strap of the present invention may be adjusted based on the location on which the fastening element is reversibly attached to the strap, thereby altering the functional length of the strap. For example, if a shorter functional strap length is desired, the fastening element would be in contact with a farther location on the strap, thereby creating a larger closed loop. Additionally, if a longer functional strap length is desired, the fastening element would be in contact with a closer location on the strap, thereby creating a smaller closed loop.

Figure 6:
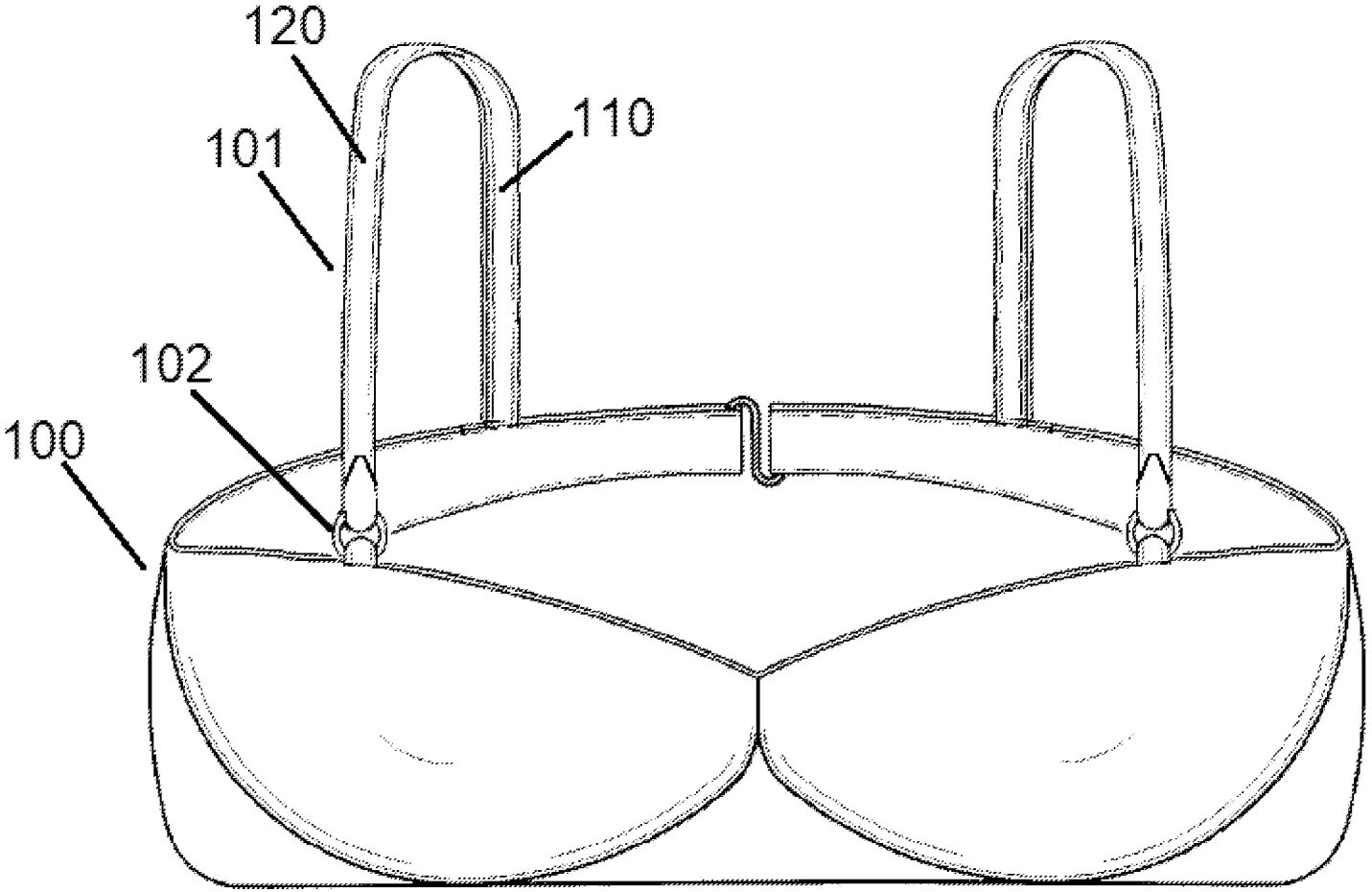
FIG. 6 is a front view of a brassiere having straps according to one embodiment of the present invention.

FIG. 6 illustrates a brassiere having straps according to one embodiment of the present invention. Brassiere 100 includes strap 101 looped around ring 102. Strap 101 includes a first layer 110 and a second layer 120, which correspond to the first and second layers previously described. Strap 101 includes a fastening element for adjusting the length of strap 101 upon being looped around ring 102, where the adjustment is based on the location on which the fastening element is reversibly attached to strap 101, particularly on second layer 120 of strap 101. Although ring 102 is illustrated in connection with the front panels of brassiere 100 in FIG. 6, a brassiere of the present invention may include a ring on one or both front panels, one or both back panels, front portions of one or both shoulder straps, and/or back portions of one or both shoulder straps. As such, a fastening element may be disposed on one or both ends of a strap of the present invention.

While a primary application of the strap of the present invention is its use as a shoulder strap in a brassiere, the strap may also be utilized as the back strap in a brassiere, replacing the traditional hook-and-eye closure. Additionally, the strap may be utilized in other apparel requiring an adjustable strap. Another application is use of the strap in sport gloves, with such sports including golf, baseball, cricket, football, lacrosse, cycling (road, mountain, BMX), skiing, snowboarding, climbing, fishing, and hunting.

It will be understood by those of ordinary skill in the art that various changes may be made and equivalents may be substituted for elements without departing from the scope of the invention. In addition, many modifications may be made to adapt a particular feature or material to the teachings of the invention without departing from the scope thereof. Therefore, it is intended that the invention not be limited to the particular embodiments disclosed, but that the invention will include all embodiments falling within the scope of the claims.

What is claimed is:

1. A strap comprising:

a first layer comprising an elastic material;

a second layer comprising a fabric material and having a first portion and a second portion, the second layer attached to the first layer; and a reversibly attachable fastening element attached to the first portion of the second layer;

wherein the fastening element is configured to attach to the second portion of the second layer when the strap is folded onto itself and the fastening element is brought into contact with the second portion of the second layer.

2. The strap of claim 1, wherein the elastic material is a non-slip material.

3. The strap of claim 2, wherein the elastic material comprises spandex.

4. The strap of claim 1, wherein the fabric material is microfiber.

5. The strap of claim 1, wherein the fabric material is tricot.

6. The strap of claim 1, wherein the fastening element is a hook-and-loop fastener.

7. The strap of claim 1, wherein the first portion of the second layer is disposed at a first end of the strap.

8. The strap of claim 7, wherein the first end of the strap has a tapered shape.

9. A garment comprising:

at least a strap;

wherein the strap comprises:

a first layer comprising an elastic material;

a second layer comprising a fabric material and having a first portion and a second portion, the second layer attached to the first layer; and a reversibly attachable fastening element attached to the first portion of the second layer;

wherein the fastening element is configured to attach to the second portion of the second layer when the strap is folded onto itself and the fastening element is brought into contact with the second portion of the second layer.

10. The garment of claim 9, wherein the garment is a brassiere.

11. The garment of claim 9, wherein the strap is a shoulder strap.

12. The garment of claim 9, further comprising a ring through which the strap is passed and then is folded onto itself.

13. The garment of claim 9, wherein the elastic material is a non-slip material.

14. The garment of claim 13, wherein the elastic material comprises spandex.

15. The garment of claim 9, wherein the fabric material is microfiber.

16. The garment of claim 9, wherein the fabric material is tricot.

17. The garment of claim 9, wherein the fastening element is a hook-and-loop fastener.

18. The garment of claim 9, wherein the first portion of the second layer is disposed at a first end of the strap.

19. The garment of claim 18, wherein the first end of the strap has a tapered shape.

20. The garment of claim 9, wherein the garment is a sport glove.

* * * * *